US008779978B1

(12) United States Patent
Lee et al.

(10) Patent No.: US 8,779,978 B1
(45) **Date of Patent: *Jul. 15, 2014**

(54) BEAMFORMING WITH PARTIAL CHANNEL KNOWLEDGE

(71) Applicant: Marvell International Ltd., Hamilton (BM)

(72) Inventors: Jongwon Lee, Cupertino, CA (US); Rohit U. Nabar, Sunnyvale, CA (US)

(73) Assignee: Marvell International Ltd., Hamilton (BM)

( * ) Notice: Subject to any disclaimer, the term of this patent is extended or adjusted under 35 U.S.C. 154(b) by 0 days.

This patent is subject to a terminal disclaimer.

(21) Appl. No.: 13/908,720

(22) Filed: Jun. 3, 2013

Related U.S. Application Data

(63) Continuation of application No. 13/619,480, filed on Sep. 14, 2012, now Pat. No. 8,456,361, which is a continuation of application No. 13/219,934, filed on Aug. 29, 2011, now Pat. No. 8,274,431, which is a continuation of application No. 13/030,738, filed on Feb. 18, 2011, now Pat. No. 8,009,097, which is a continuation of application No. 12/192,264, filed on Aug. 15, 2008, now Pat. No. 7,893,871.

(60) Provisional application No. 60/978,942, filed on Oct. 10, 2007.

(51) Int. Cl.
*H01Q 3/00* (2006.01)

(52) U.S. Cl.
USPC ..... 342/373

(58) Field of Classification Search
USPC ..... 342/373
See application file for complete search history.

(56) References Cited

U.S. PATENT DOCUMENTS

| | | | |
|---|---|---|---|
| 6,600,446 | B2 | 7/2003 | Moch |
| 6,697,633 | B1 | 2/2004 | Dogan et al. |
| 7,224,758 | B1 | 5/2007 | Banister |
| 7,242,961 | B2 | 7/2007 | Hansen |
| 7,729,439 | B2 | 6/2010 | Zhang et al. |
| 2003/0002450 | A1 | 1/2003 | Jalali et al. |
| 2005/0152299 | A1 | 7/2005 | Stephens |
| 2005/0157805 | A1 | 7/2005 | Walton et al. |
| 2005/0195733 | A1 | 9/2005 | Walton et al. |
| 2005/0265275 | A1 | 12/2005 | Howard et al. |
| 2007/0015526 | A1 | 1/2007 | Hansen |
| 2007/0293214 | A1 | 12/2007 | Ansari et al. |

(Continued)

OTHER PUBLICATIONS

Browne, "David Browne—Beamforming Nugget," available at http://www.ee.ucla.edu/~decibel/nugget_beamforming.html., Jun. 26, 2008, pp. 1-5.

(Continued)

*Primary Examiner* — Harry Liu

(57) ABSTRACT

An apparatus for use in transmit beamforming to a beamformee having $N_R$ receive antennas. The apparatus includes a controller configured to i) construct a partial channel matrix that describes a multiple input, multiple output (MIMO) channel between a beamformer and M receive antennas, wherein M is less than $N_R$, and ii) generate L independent vectors using the partial channel matrix, wherein L is a rank of the partial channel matrix. When a number $N_S$ of one or more streams is greater than L, the controller is further configured to i) select the L independent vectors as steering vectors to steer L streams of the plurality of streams, and ii) select $N_S$–L orthogonal vectors in a null space of the L independent vectors as steering vectors to steer a remainder of the streams in the plurality of streams.

22 Claims, 5 Drawing Sheets

(56) References Cited

U.S. PATENT DOCUMENTS

| | | | |
|---|---|---|---|
| 2007/0298742 | A1 | 12/2007 | Ketchum et al. |
| 2008/0187032 | A1 | 8/2008 | Pande et al. |
| 2008/0247370 | A1 | 10/2008 | Gu et al. |
| 2011/0305205 | A1 | 12/2011 | Gong et al. |

OTHER PUBLICATIONS

S. A. Mujtaba, "IEEE P802.11—Wireless LANs, TGn Sync Proposal Technical Specification," *The Institute of Electrical and Electronics Engineers, Inc*., doc.: IEEE 802.11-04/0889r6, May 2005.

"IEEE P802.11n™/D3.00, Draft Standard for Information Technology—Telecommunications and information exchange between systems—Local and metropolitan area networks—Specific requirements, Part 11: Wireless LAN Medium Access Control (MAC) and Physical Layer (PHY) specifications: Amendment 4: Enhancements for Higher Throughput," *The Institute of Electrical and Electronics Engineers, Inc*., Sep. 2007.

van Nee, et al. "The 802.11n MIMO-OFDM Standard for Wireless LAN and Beyond," Wireless Personal Communications, vol. 37, pp. 445-453 (Jun. 2006).

Zhang et al., "Applying Antenna Selection in WLANs for Achieving Broadband Multimedia Communications," IEEE Trans. on Broadcasting, vol. 52, No. 4, Dec. 2006.

BEAMFORMING WITH PARTIAL CHANNEL KNOWLEDGE

CROSS-REFERENCE TO RELATED APPLICATIONS

This application is a continuation of U.S. application Ser. No. 13/619,480, now U.S. Pat. No. 8,456,361, entitled "Beamforming with Partial Channel Knowledge," filed Sep. 14, 2012, which is a continuation of U.S. application Ser. No. 13/219,934, now U.S. Pat. No. 8,274,431, entitled "Beamforming with Partial Channel Knowledge, filed on Aug. 29, 2011, which is a continuation of U.S. application Ser. No. 13/030,738, now U.S. Pat. No. 8,009,097, filed on Feb. 18, 2011, which is a continuation of U.S. application Ser. No. 12/192,264, now U.S. Pat. No. 7,893,871, filed on Aug. 15, 2008, which claims priority under 35 U.S.C. §119(e) to U.S. Provisional Application No. 60/978,942, filed on Oct. 10, 2007. All of the applications referenced above are hereby incorporated by reference.

BACKGROUND

The basis of multiple-input/multiple-output (MIMO) operation is to provide wireless devices with multiple radio interfaces to allow the devices to send data on different channels at the same time in order to achieve greater transmit/receive data rates and with greater reliability. In MIMO systems, a transmitter sends multiple streams of encoded data packets to a receiver by multiple transmit antennas. The streams may be spatially and time encoded and converted into multiple RF signals. The signals are transmitted to the receiver on multiple channels between multiple transmit antennas at the transmitter and multiple receive antennas at the receiver. When the receiver receives the signal vectors from the multiple receive antennas, the receiver decodes the received signal vectors into the original information.

A spatially multiplexed MIMO system that uses multiple transmit and receive antennas not only transmits data between the corresponding transmit and receive antennas but also between adjacent antennas. Thus, data is received in the form of a MIMO channel matrix. Linear algebra techniques such as singular value decomposition (SVD) or matrix inversion may be required to decouple the channel matrix in the spatial domain and recover the transmitted data. The transmitter typical requires some knowledge of the channel state to effectively transmit the streams. One approach for estimating the channel state is to use channel reciprocity, which is generally based on the theory that if a link operates on the same frequency band in both directions, an impulse response of the channel observed between any two antennas may be the same regardless of the direction.

In a MIMO system having a m transmit antennas and n receive antennas, an (n×m) time varying matrix H is typically denoted as the channel matrix representing the physical propagation channel, where each column represents a channel gain from each transmit antenna of the transmitter to n receive antennas of the receiver.

The channel by which the transmitter transmits the data stream to the receiver is referred to as the forward channel, and may be represented as a channel matrix $H_f$. The channel from the receiver to the transmitter is referred to as backward channel, and may be represented as channel matrix $H_b$. Channel reciprocity means that a forward channel and a backward channel are equivalent. Mathematically, channel reciprocity can be defined as:

$$H_b^T = H_f$$

where T is matrix transpose operation.

A forward channel matrix is a transposed version of the backward channel matrix. For example, the forward channel from transmit antenna 1 to receive antenna 2 is the same as the backward channel from receive antenna 2 to transmit antenna 1.

MIMO performance has been improved through the use of beamforming techniques. Beamforming allows multi-antenna radios to communicate multiple streams of information across a multipath channel such that all streams use the same radio spectrum but do not interfere. Beamforming takes advantage of interference to change the directionality of an antenna array. When transmitting in beamforming, the transmitter is the beamformer and the receiver is the beamformee. The phase and relative amplitude of a signal of beamformer is controlled in order to shape the transmitted beam pattern narrower, such that the energy is transmitted in a particular direction of the beamformee, in contrast to an omni-directional beam pattern that transmits energy in every direction. When used in a WLAN or cellular environment, beamforming can result in increased received signal power and reduced interference power at the receiver/mobile station.

Several types of beamforming are known, such as beamforming with full channel knowledge and beamforming with no channel knowledge. Beamforming with full channel knowledge can be achieved via two different techniques. One technique for determining full channel knowledge is for beamformer to transmit known training sequences from beamformer transmit antennas to receive antennas of the beamformee to enable the beamformee to estimate channel state information and determine the full channel matrix $H_f$. Then the beamformee feeds back the forward channel $H_f$ to the beamformer.

Another technique for determining full channel knowledge may be referred to as implicit beamforming. Implicit beamforming calls for the beamformee to "sound the backward channel," wherein the beamformee sends a known signal to the beamformer. The beamformer then estimates the channel state information for $H_b$ and infers $H_f$ based on channel reciprocity.

Once the beamformer determines full channel knowledge of the forward channel, i.e., the full channel matrix $H_f$, the beamformer can perform beamforming. In a downlink situation where the beamformer and the beamformee know $H_f$, they can employ Singular Value Decomposition (SVD) to use input and output singular vectors of $H_f$ to spatially multiplex and demultiplex the transmitted and received vectors to form multiple spatial filters, called beams, with their antenna arrays. In other words, the beams are "steered" in the direction of the receiver. The result of this mux/demux operation is that information symbols in x are communicated through the channel matrix in parallel and without inter-symbol interference. The received symbols are the transmitted symbols scaled by a corresponding singular value, S, but may be corrupted by background noise.

Beamforming may also be performed with no channel knowledge. In beamforming with no channel knowledge, the beamformer randomly generates the steering vector without knowledge of the forward channel to the beamformee. For example, the beamformer may randomly generate a steering vector such that at time 0, a signal is transmitted in a North direction; at time 1, a signal is transmitted in an East direction; at time 2, a signal is transmitted in a South direction; and at time 3, a signal is transmitted in a West direction. Beamformees that receive a strong signal may send a feedback signal reporting that the signal was received and beamformees that received a weak signal may send a feedback signal reporting that the received signal was weak. The beamformer may then decide to which reporting beamformees to allocate the forward channel. Beamforming with no channel knowledge is effective when there are many beamformees associated with a given a station because the beamformer beamforms to an arbitrary direction, and in most cases, the beamformees will be spread over a whole coverage area in all directions, particularly in cellular systems.

Although beamforming with full channel knowledge and beamforming with no channel knowledge are effective techniques, in some situations, only partial channel knowledge exists. In some MIMO systems, the number of transmit chains in the beamformee can differ from the number of receive chains. For example, in many conventional WiMAX systems, beamformees may have two receive chains, but only one transmit chain, while in WiFi systems, beamformees may have three receive chains and two transmit chains. Typically, the number of transmit chains is smaller than the number of receive chains.

In implicit beamforming based on the beamformee sounding the backward channel, it is assumed that the beamformee sends the known signal to the beamformer on all transmit antennas in order for the beamformer to determine the forward channel. Sometimes, however, the beamformee may not send the known signal to the beamformer using all available transmit antennas. That is, the beamformee may sound only from a subset of available transmit antennas. In this case, only channels from a subset of beamformee transmit antennas may be known to the beamformer. So equivalently, only a partial channel matrix, i.e., a subset of columns of the backward channel $H_b$, is known. And through channel reciprocity, only a subset of rows of the forward channel $H_f$ will be known to the beamformer. Thus, in this situation, beamforming needs to be done based on the partial channel knowledge, i.e., only a subset of rows of the forward channel $H_f$.

SUMMARY OF THE DISCLOSURE

In one embodiment, a method, in a transmitter, is for selecting steering vectors for transmitting one or more streams between the transmitter and a receiver, wherein the transmitter has a plurality of transmit antennas, the receiver has a plurality of receive antennas, the number of receive antennas in the plurality of receive antennas is $N_R$, and the number of streams in the one or more steams is $N_S$. The method includes constructing a partial channel matrix that describes a multiple input, multiple output (MIMO) channel between the plurality of transmit antennas and a set of one or more of the receive antennas, wherein the number of receive antennas in the set of one or more of the receive antennas is M, and M is less than $N_R$, and generating one or more independent vectors using the partial channel matrix, wherein the number of independent vectors in the one or more independent vectors is L, and L is a rank of the partial channel matrix. The method also includes, when $N_S$ is greater than L, (i) selecting the one or more independent vectors as one or more first steering vectors to steer a first set of one or more streams in the one or more streams, wherein the number of streams in the first set of one or more streams is L; (ii) selecting one or more orthogonal vectors in a null space of the one or more independent vectors as one or more second steering vectors to steer a second set of one or more streams in the one or more streams, wherein the number of orthogonal vectors in the one or more orthogonal vectors is $N_S$–L, wherein the number of streams in the second set of one or more streams is $N_S$–L, and the $N_S$–L streams in the second set of one or more streams are not in the first set of one or more streams; (iii) utilizing the one or more first steering vectors for transmitting the first set of one or more streams; and (iv) utilizing the one or more second steering vectors for transmitting the second set of one or more streams.

In another embodiment, an apparatus is for use in transmit beamforming to a beamformee, wherein the beamformee has $N_R$ a plurality of receive antennas, wherein the number of receive antennas in the plurality of receive antennas is $N_R$. The apparatus comprises a controller configured to implement the method described above.

DETAILED DESCRIPTION

The present invention relates to beamforming with partial channel knowledge. The following description is presented to make and use the invention and is provided in the context of a patent application and its requirements. Various modifications to the preferred embodiments and the generic principles and features described herein will be readily apparent to those skilled in the art. Thus, the present invention is not intended to be limited to the embodiments shown, but is to be accorded the widest scope consistent with the principles and features described herein.

The preferred embodiment provides methods and systems for beamforming with partial channel knowledge for use in MIMO devices. The exemplary embodiments will be described in terms of MIMO beamforming in the context of an exemplary downlink cellular system comprising a base station and a mobile station. However, the exemplary embodiments are applicable to any MIMO system and other types of wireless communication devices in which beamforming occurs between a beamformer device and a beamformee device. The exemplary embodiments will also be described in the context of particular methods having certain steps. However, the method and system operate effectively for other methods having different and/or additional steps and steps in different orders not inconsistent with the exemplary embodiments.

Figure 1:
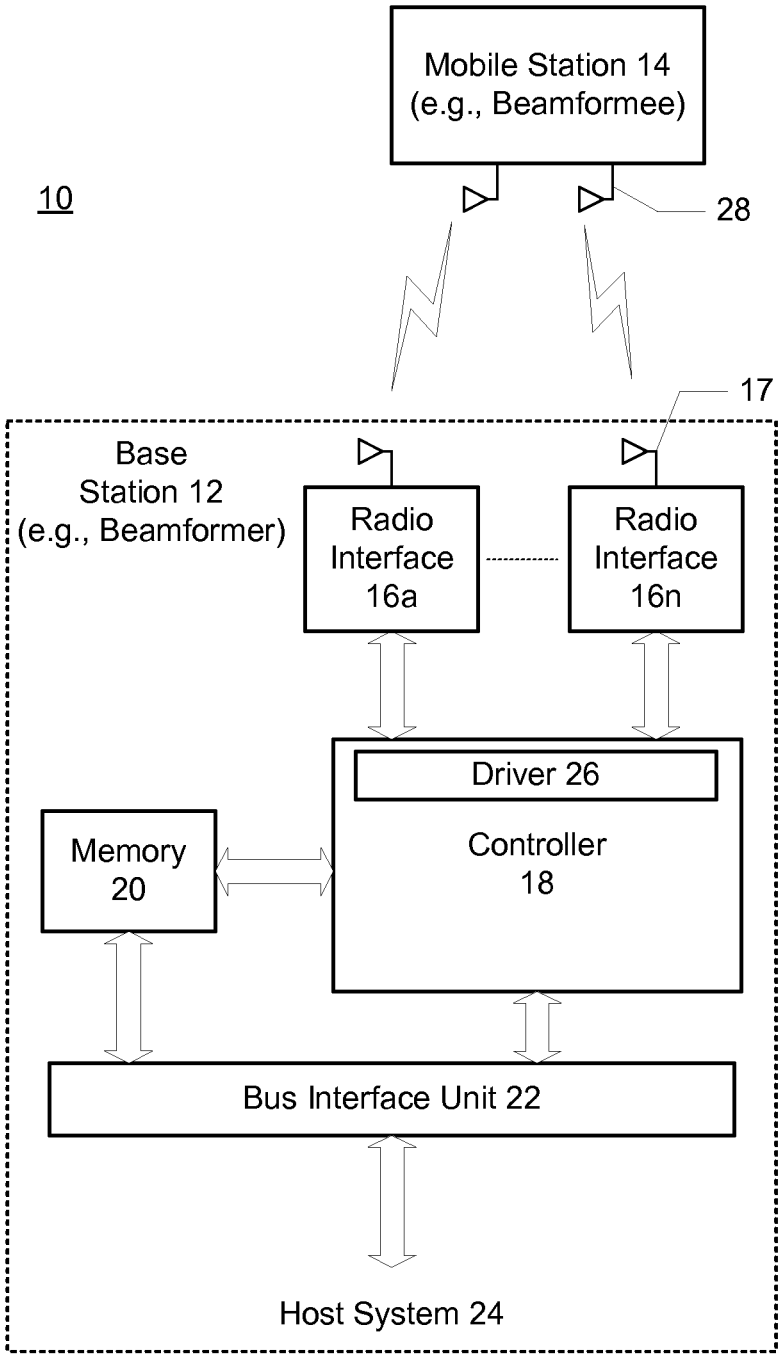
FIG. 1 is a block diagram illustrating an exemplary wireless communication system.

FIG. 1 is a block diagram illustrating an exemplary wireless communication system. The wireless communication system 10 includes a base station 12 that is in wireless communication with one or more mobile stations 14. The mobile station 14 and the base station 12 communicate through the transmission of signals in the form of streams of encoded data packets over one or more radio frequency (RF) channels. In one exemplary embodiment, both the base station 12 and the mobile station 14 comprise MIMO devices. In one embodiment, the mobile station 14 may comprise a cellular handset, and together with the base station 12, provides cellular services. In another embodiment, the base station 12 may comprise an access point that may be located indoors and the mobile station 14 may be a network device or client station that is used in a desktop/portable computer for communication, for example.

The base station 12 may include two or more independent radio interfaces 16*a* and 16*n* (referred herein as radio interface(s) 16) for processing one or more data streams, a controller 18 coupled to the radio interfaces 16, a memory 20 coupled to the controller 18, and a bus interface unit 22 coupled to the controller 18 and to the memory 20 for transmitting data to a host 24 over a host system bus. The mobile station 14 may include a similar architecture.

The radio interfaces 16 are independent from each other because each radio interface 16 has its own antenna 17 and RF chain (not shown). Each RF chain and its corresponding antenna 17 may be capable of transmitting/receiving and processing a data stream. A single frame of data can be broken up and multiplexed across multiple data streams and reassembled at the receiver, which may have the benefits of resolving multipath interference and improving the quality of the received signal. Each of the radio interfaces 16 may be configured as a transceiver, which is capable of operating as both a transmitter and a receiver.

The driver 26 is software or firmware that controls the radio interfaces 16 and can process the data if needed. The driver 26 is executed by the controller 18. The controller 18 may comprise an ASIC, a DSP or other type of processor. The memory 20 stores the incoming and outgoing data packets and any other data needed by the driver 26. The bus interface unit 22 transfers data between the host system 24, and the controller 18 and the memory 20.

In the context of the exemplary cellular system above, a transmission from the base station 12 to the mobile station 14 is known as a downlink transmission, while a transmission from the mobile station 14 to the base station 12 is known as an uplink transmission. During a downlink transmission, the base station 12 transmits information to the mobile station 14 through the transmission of encoded data packets. The data is parallel processed at the base station 12 using a spatial and time encoding function to produce two or more streams of data. Each stream of data is converted into multiple RF signals and transmitted to the mobile station 14 on multiple channels. The transmit streams are transmitted through a channel matrix comprising multiple paths between multiple transmit antennas at the base station 12 and one or more receive antennas at the mobile station 14. The mobile station 14 receives the multiple RF signals on the multiple channels via receive antennas that recapture the streams of data utilizing a spatial and time decoding function. The mobile station 14 combines and processes/decodes the recaptured streams of data to recover the original data.

In referring to a MIMO system, the concept of beamforming includes a beamformer that transmits a beamformed signal. The receiver of the beamformed signal may be referred to as the beamformee. If beamforming is applied during a downlink transmission in the wireless communication system 10, then the base station 12 is the beamformer and the mobile station 14 is the beamformee. If beamforming is applied during an uplink transmission, then the mobile station 14 is the beamformer and the base station 12 is the beamformee. The forward channel is the channel over which transmission occurs from the beamformer to the beamformee, and the backward channel is the channel over which transmission occurs from the beamformee to the beamformer.

In one embodiment, the devices in the wireless communication system 10 may have a different number of receive antennas than transmit antennas. In one embodiment, the system 10 may minimally require a 2×2 configuration that has two transmit chains and two receive chains, which allows for two data streams multiplexed across a radio link. Current standards for Worldwide Interoperability for Microwave Access (WiMAX) configuration, as another example, require a minimum of 2 receive antennas and 1 transmit antenna for the mobile station 14.

Thus, the base station 12 can be described as having a plurality of $N_{B,R}$ receive antennas and $N_{B,T}$ transmit antennas. Similarly, the mobile station 14 can be described as having a plurality of $N_{M,R}$ receive antennas and $N_{M,T}$ transmit antennas. As described above, in beamforming during a downlink, the beamformer (i.e., the base station 12) beamforms from one or more transmit antennas to one or more receive antennas of the beamformee (i.e., the mobile station 14). One important factor in beamforming is the number of transmit antennas of the beamformer and the number of receive antennas of the beamformee, which can be designed as, $N_T=N_{B,T}$, and $N_R=N_{M,R}$, respectively.

Beamforming for the MIMO system can be modeled as, $$y=Hx+n$$

where y represents a $N_R$x1 received signal vector, H represents a $N_R x N_T$ channel matrix, x represents a $N_T$x1 transmit signal vector, and n represents a $N_R$x1 noise vector.

Figure 2:
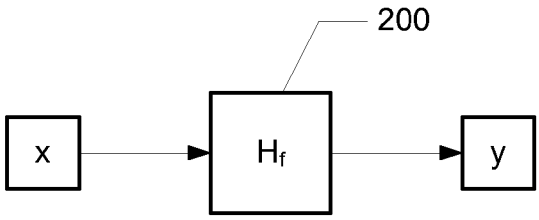
FIG. 2 is a diagram graphically representing the modeled MIMO system.

FIG. 2 is a diagram graphically representing the modeled MIMO system. In the exemplary downlink embodiment where the beamformer transmits to one or more of the receive antennas of the beamformee, the x illustrates the transmit signal vector representing one or more transmit streams transmitted in a channel 200 between the beamformer and the beamformee. The y illustrates the received signal vector received by the beamformee. The channel 200 from the beamformer to the beamformee is represented by a forward channel matrix $H_f$ that has a dimension of ($N_R X N_T$). By transpose, a backward channel $H_b$ from the beamformee to the beamformer has a dimension of ($N_T X N_R$). The ranks of the forward and backward channel matrixes are less than or equal to the minimum of the number of transmit antennas $N_T$ and the number of receive antennas $N_R$.

In implicit beamforming based on the beamformee/mobile station 14 sounding the backward channel, sometimes, the beamformee may sound only from a subset of available transmit antennas. In other words, only a partial channel matrix, i.e., a subset of columns of the backward channel $H_b$ is known. And through channel reciprocity, only a subset of rows of the forward channel $H_f$ will be known to the beamformer/base station 12. In this situation, the beamformer only has partial channel knowledge, i.e., a partial channel matrix, of the forward channel. The rank of the partial channel matrix will be equal to or less than the number of the beamformee transmit antennas known to the beamformer.

This signal model is applicable to any MIMO system, but for purposes of this disclosure, this MIMO beamforming is described in the context of a downlink cellular system, but may be applied to other types of wireless MIMO systems. This signal model applies to orthogonal frequency division multiplexing (OFDM) system on a per-tone basis. Here just one tone is represented per channel, but if there are multiple subcarriers with OFDM, then there may be parallel channels. As long as the beamforming is done subcarrier by subcarrier, i.e., tone by tone, then this signal model should be sufficient.

Figure 3:
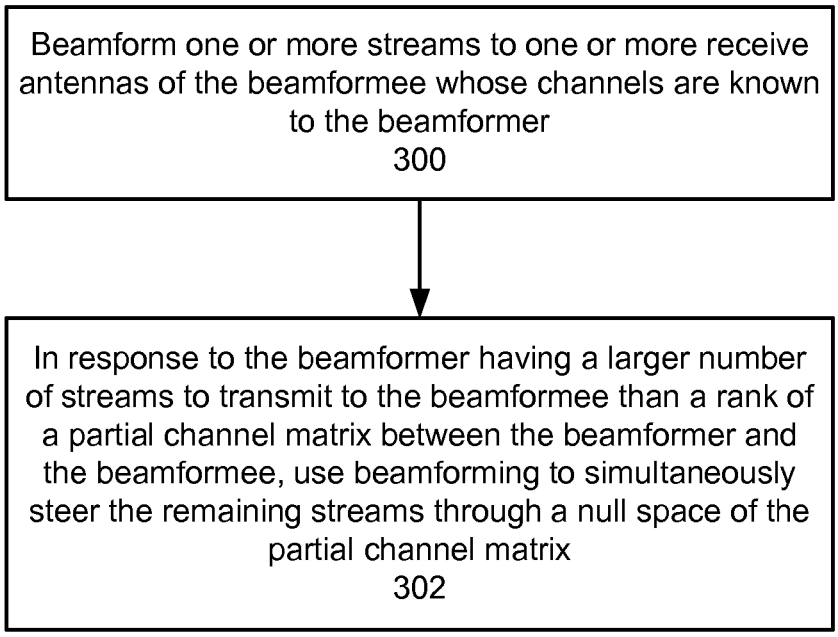
FIG. 3 is flow diagram illustrating a process for beamforming with partial channel knowledge.

FIG. 3 is flow diagram illustrating a process for beamforming with partial channel knowledge in accordance with an exemplary embodiment. In one embodiment, the process may be implemented by the driver 26. The process may begin by the beamformer beamforming one or more streams to one or more receive antennas of the beamformee whose channels are known to the base station 12 (block 300). In response to the beamformer having a larger number of streams to transmit to the beamformee than a rank of a partial channel matrix between the beamformer and the beamformee, then the beamformer uses beamforming to simultaneously steer the remaining streams through a null space of the partial channel matrix (block 302). Each additional stream may be assigned to each orthogonal direction of the null space. This is possible because the dimension of the null space is always larger than or equal to the number of remaining streams.

Figure 4:
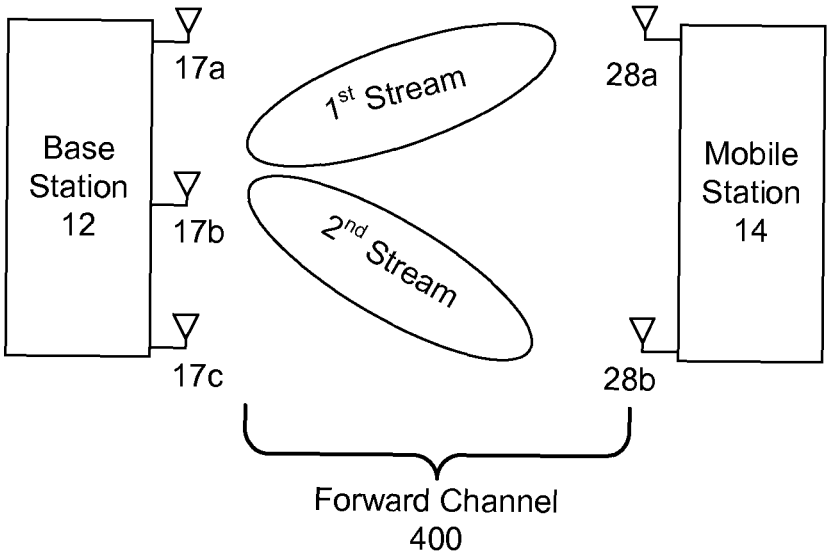
FIG. 4 is a block diagram graphically illustrating an example of beamforming with partial channel knowledge.

FIG. 4 is a block diagram graphically illustrating an example of beamforming with partial channel knowledge. In this example, the base station 12 is shown with three transmit antennas 17*a*, 17 *b*, 17*c* and the mobile station 14 is shown with two receive antennas 28*a*, 28*b*. In this example, the base station 12 needs to transmit two streams, and the base station 12 knows the channel for receive antenna 28*a*, but not the channel for receive antenna 28*b*, and thus only has partial channel knowledge of the forward channel 400.

Therefore, according to the exemplary embodiment, the base station 12 beamforms a first stream from transmit antenna 17*b* to receive antenna 28*a* on the channel which is known. The first stream is physically transmitted in the forward channel 400 as a main lobe width (the beam), sidelobes, and null spaces. According to the exemplary embodiment, the base station 12 simultaneously beamforms a second stream from the transmit antenna 17*b* through a null space of the partial channel matrix. This is shown graphically as transmitting the second stream through at least a portion of the null spaces in the forward channel 400, such that the second stream is not received by the receive antenna 28*a* of the mobile station 14 whose channel is known by the base station 12.

Figure 5:
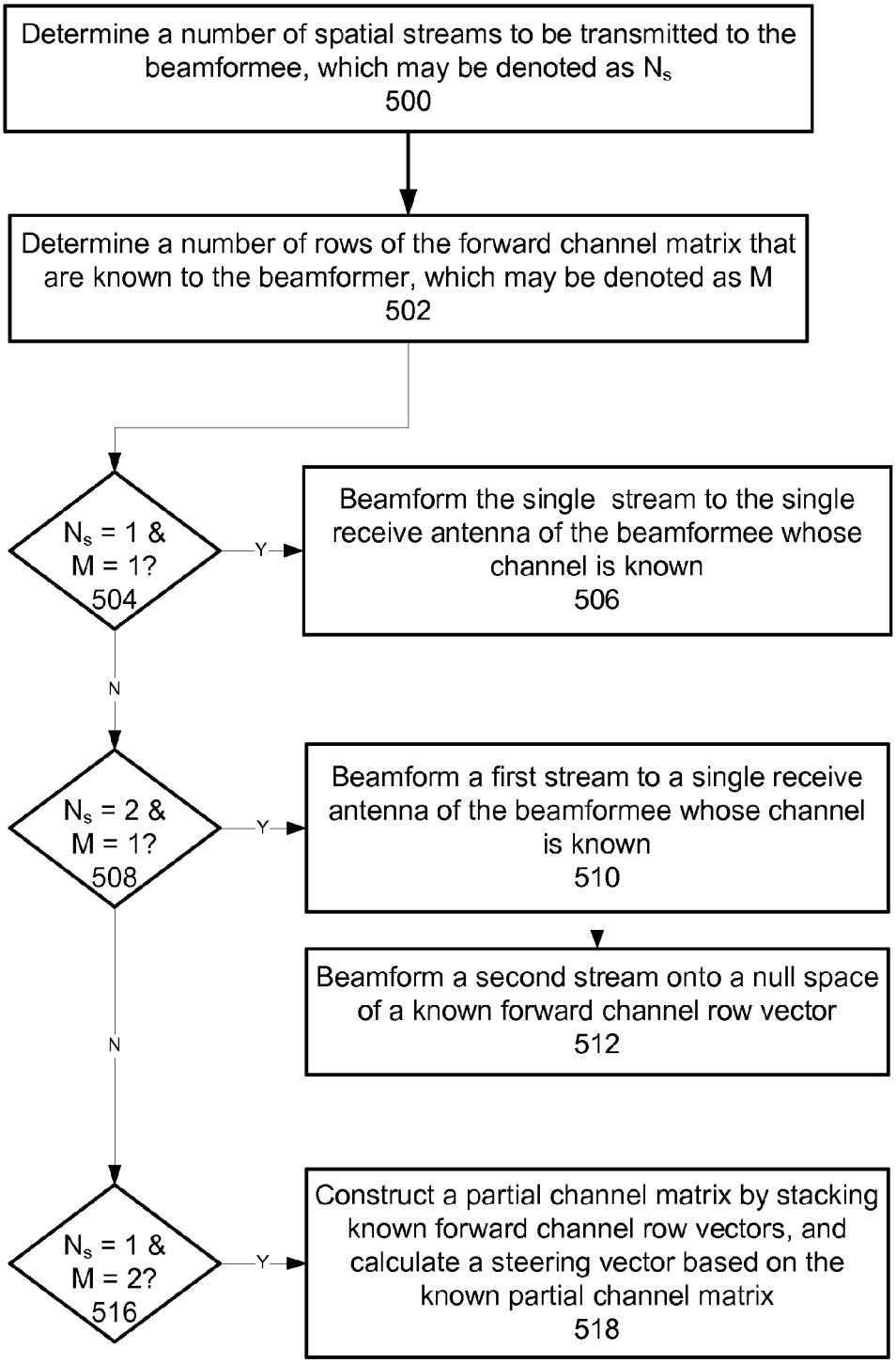
FIG. 5 is a flow diagram illustrating the process for beamforming with partial channel knowledge in further detail according to an exemplary embodiment.

FIG. 5 is a flow diagram illustrating the process for beamforming with partial channel knowledge in further detail according to an exemplary embodiment. The process may begin with the beamformer determining a number of spatial streams $N_s$ to be transmitted to the beamformee (block 500). In one embodiment, the number of spatial streams N, to be transmitted to the beamformee is kept less than or equal to a minimum of the number $N_R$ of receive antennas of the beamformee and the number $N_T$ of the transmit antennas of the beamformer, $$N_S \leq \min\{N_R, N_T\}$$

The beamformer may then determine a number of rows M of the forward channel matrix that are known to the beamformer (block 502). Conventional techniques, such as sounding the backward channel may be used to determine a number of rows of the forward channel matrix that are known to the beamformer. The number of streams that the beamformer can transmit effectively is limited by the number of receive antennas 28 on the beamformee. By channel reciprocity, the number of transmit antennas 28 on the beamformee indicates the number of rows of the forward channel matrix known to the beamformer.

It is determined if $N_S$=1 and M=1 (block 504). In this case, the number of spatial streams to be transmitted to the beamformee is 1 and the number of rows of the forward channel matrix that are known to the beamformer is 1.

If $N_S$=1 and M=1, then the beamformer has channel knowledge of the receive antenna 28*a* of the beamformee, and even if the beamformee has more than one receive antenna, the beamformer beamforms the single stream to the single receive antenna 28*a* of the beamformee whose channel is known (block 506).

It is determined if $N_S$=2 and M=1 (block 508), in which case the number of spatial streams to be transmitted to the beamformee is greater than the number of rows of the forward channel matrix that are known to the beamformer. When $N_S$=2 and M=1, the beamformer has two streams to transmit, but only has knowledge of one channel to one receive antenna 28*a*.

If $N_S$=2 and M=1, then the beamformer beamforms a first stream to a single receive antenna 28*a* of the beamformee whose channel is known (block 510). The beamformer also simultaneously beamforms a second stream onto a null space of a known forward channel row vector (block 512). If the null space has more than one dimension, then a steering vector for the second stream can be randomized within a subspace of the null space as is done in opportunistic beamforming.

It is determined if $N_S$=1 and M=2 (block 516), in which case the number of spatial streams to be transmitted to the beamformee is less than the number of rows of the forward channel matrix that are known to the beamformer. When $N_S$=1 and M=2, the beamformer has only one stream to transmit, but has knowledge of two channels to two receive antennas 28*a*, 28*b*.

If $N_S$=1 and M=2, then a partial channel matrix can be constructed by stacking the known forward channel row vectors, and a steering vector can be calculated based on the known partial channel matrix (block 518). By constructing the partial channel matrix with the known forward channel row vectors, the beamformer is provided with full channel knowledge of the partial channel matrix. In one embodiment, singular value decomposition (SVD) may be used to calculate the steering vector. If SVD is used to calculate a steering vector, the steering vector may be chosen as the input singular vector having a larger corresponding singular value. In another embodiment, techniques other than SVD may be employed, such as (generalized) co-phasing, and matrix inversion, for example.

Figure 6:
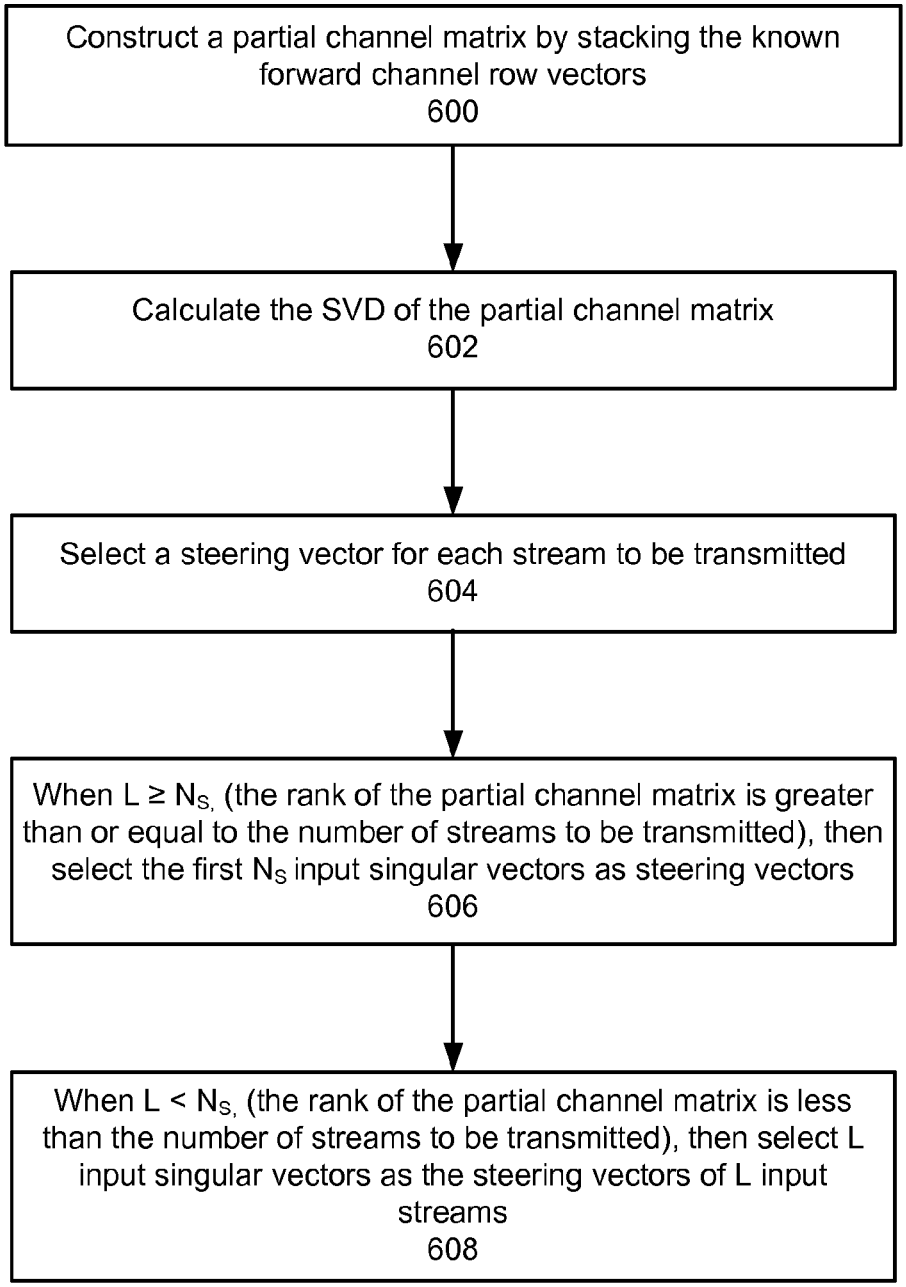
FIG. 6 is a flow diagram illustrating a process for beamforming streams onto the null space of the known forward channel row vector in further detail.

FIG. 6 is a flow diagram illustrating a process for beamforming streams onto the null space of the known forward channel row vector (block 512) in further detail. In one embodiment, beamforming streams onto the null space of the known forward channel row vectors is accomplished by steering the streams to a null space of the partial channel matrix. The process comprises constructing the partial channel matrix by stacking the known forward channel row vectors (block 600):

$$H_{f,Partial} = \begin{bmatrix} h_{f,1}^T \\ h_{f,2}^T \\ \vdots \\ h_{f,M}^T \end{bmatrix}$$

where $h_{f,1}^T$, $h_{f,2}^T$, . . . , $h_{f,M}^T$ represent the known forward channel row vectors. The number of forward channel row vectors in the partial channel matrix is the rank of the partial channel matrix. As stated above, by constructing the partial channel matrix with the known forward channel row vectors, the beamformer is provided with full channel knowledge of the partial channel matrix.

With full channel knowledge of the partial channel matrix and SVD-based steering, the beamformer calculates the SVD of the partial channel matrix $H_{f,Partial}$ (block 602). The calculation of SVD on the partial channel matrix $H_{f,}$ Partial uses steering vectors to spatially multiplex the known forward channel row vectors to form the transmitted beams, $$H_{f,Partial}=U\Sigma V^*$$

where $$\sum = \begin{bmatrix} \sigma_1 & 0 & \dots & 0 \\ 0 & \sigma_2 & \dots & 0 \\ \vdots & \vdots & \ddots & \vdots \\ 0 & 0 & \dots & \sigma_L \end{bmatrix}$$

represents a singular value matrix, and singular values are ordered: $\sigma_1 \geq \sigma_2 \geq \dots \geq \sigma_L > 0$;

$V=[v_1 \dots v_L]$ represents an input singular steering matrix;

$v_1, \dots, v_L$: represent input singular vectors; and

L represents a rank of the partial channel matrix.

The beamformer selects a steering vector for each stream to be transmitted (block 604). When $L \geq N_s$, (the rank of the partial channel matrix is greater than or equal to the number of streams to be transmitted), then the beamformer selects the first $N_S$ input singular vectors $v_1, \dots, v_L$ as steering vectors (block 606). When $L<N_S$, (the rank of the partial channel matrix is less than the number of streams to be transmitted), then the beamformer selects L input singular vectors as the steering vectors of L input streams (block 608). The beamformer also selects $N_S-L$ orthogonal vectors in a dimension of the null space $N_T-L$. If $N_T>N_S$, the orthogonal vectors can be varied within the $N_T-L$ dimensional null space over time or frequency. If $N_T=N_S$, the assignment of the orthogonal vectors to each stream can be varied over time or frequency.

A method and system for beamforming with partial channel knowledge has been described. The principles herein may be readily expanded. For example if some information about the other receive antennas is available, that information can be utilized. For example, if channel statistics of other receive antennas is known, the beams for those receive antennas can be matched to the statistics. Also, the desired number of streams can be determined based on the effective channel quality dynamically. Furthermore, transmit power may be allocated between the spatial streams that are beamformed onto the known channel and the spatial streams that are beamformed onto the corresponding null space. More generally, power may be allocated across the spatial streams to meet target error rate criteria.

The present invention has been described in accordance with the embodiments shown, and there could be variations to the embodiments, and any variations would be within the spirit and scope of the present invention. For example, the present invention can be implemented using hardware, software, a computer readable medium containing program instructions, or a combination thereof. Software written according to the present invention is to be either stored in some form of computer-readable medium such as memory or CD or DVD-ROM, or is to be transmitted over a network, and is to be executed by a processor. Accordingly, many modifications may be made without departing from the spirit and scope of the appended claims.

We claim:

1. A method, in a transmitter, for selecting steering vectors for transmitting one or more streams between the transmitter and a receiver, wherein the transmitter has a plurality of transmit antennas, the receiver has a plurality of receive antennas, the number of receive antennas in the plurality of receive antennas is $N_R$, and the number of streams in the one or more steams is $N_S$, the method comprising:

constructing a partial channel matrix corresponding to an estimate of a multiple input, multiple output (MIMO) channel between (i) the plurality of transmit antennas and (ii) a set of one or more of the receive antennas, wherein the number of receive antennas in the set of one or more of the receive antennas is M, and M is less than $N_R$;

generating one or more independent vectors using the partial channel matrix, wherein the number of independent vectors in the one or more independent vectors is L, and L is a rank of the partial channel matrix; and when $N_S$ is greater than L, (i) selecting the one or more independent vectors as one or more first steering vectors to steer a first set of one or more streams in the one or more streams, wherein the number of streams in the first set of one or more streams is L, (ii) selecting one or more orthogonal vectors in a null space of the one or more independent vectors as one or more second steering vectors to steer a second set of one or more streams in the one or more streams, wherein the second set of one or more streams are not in the first set of one or more streams, (iii) utilizing the one or more first steering vectors for transmitting the first set of one or more streams, and (iv) utilizing the one or more second steering vectors for transmitting the second set of one or more streams.

2. The method of claim 1, wherein:

the number of transmit antennas in the plurality of transmit antennas is $N_T$, and a dimensionality of the null space is $N_T-L$.

3. The method of claim 1, further comprising selecting, over time, different orthogonal vectors as the one or more second steering vectors.

4. The method of claim 1, further comprising selecting, over frequency, different orthogonal vectors as the one or more second steering vectors.

5. The method of claim 1, wherein generating one or more independent vectors using the partial channel matrix includes performing singular value decomposition (SVD) of the partial channel matrix.

6. The method of claim 1, wherein constructing the partial channel matrix comprises:

determining an additional partial channel matrix corresponding to a reverse channel; and determining the partial channel matrix from the additional partial channel matrix.

7. The method of claim 1, wherein when i) $N_S=2$ and ii) M=1:

selecting the one or more independent vectors as the one or more first steering vectors comprises selecting one independent vector to steer a first stream to a single receive antenna of the receiver; and selecting the one or more orthogonal vectors in the null space of the one or more independent vectors comprises selecting a vector to steer a second stream in a null space of a row vector in the partial channel matrix.

8. The method of claim 1, further comprising, when $N_S$ is less than or equal to L, selecting a set of one or more independent vectors as a third set of one or more steering vectors to steer the one or more streams, wherein the number of independent vectors in the set of independent vectors is $N_S$.

9. The method of claim 8, wherein when i) $N_S=1$ and ii) M=1:

selecting the set of one or more independent vectors as the third set of one or more steering vectors to steer the one or more streams comprises selecting one independent vector to steer the one stream to a single receive antenna of the receiver.

10. The method of claim 8, wherein when i) $N_S$=1 and ii) M=2:

generating the one or more independent vectors using the partial channel matrix comprises generating a single independent vector using the partial channel matrix, and selecting the set of one or more independent vectors as the third set of one or more steering vectors to steer the one or more streams comprises selecting the single independent vector to steer the one stream.

11. An apparatus for use in transmit beamforming to a beamformee, wherein the beamformee has a plurality of receive antennas, wherein the number of receive antennas in the plurality of receive antennas is $N_R$, the apparatus comprising:

a controller configured to construct a partial channel matrix that corresponds to an estimate of a multiple input, multiple output (MIMO) channel between a beamformer and a set of one or more of the plurality of receive antennas, wherein the number of receive antennas in the set of one or more receive antennas is M, and M less than $N_R$, generate one or more independent vectors using the partial channel matrix, wherein the number of independent vectors in the one or more independent vectors is L, and L is a rank of the partial channel matrix, and when a number $N_S$ of one or more streams is greater than L:

(i) select the one or more independent vectors as one or more first steering vectors to steer a first set of one or more streams in the one or more streams, wherein the number of streams in the first set of one or more streams is L;

(ii) select one or more orthogonal vectors in a null space of the one or more independent vectors as one or more second steering vectors to steer a second set of one or more streams in the one or more streams, wherein the second set of one or more streams are not in the first set of one or more streams;

(iii) cause the one or more first steering vectors to be used to transmit the first set of one or more streams; and (iv) cause the one or more second steering vectors to be used to transmit the second set of one or more streams.

12. The apparatus of claim 11, wherein the beamformer has $N_T$ transmit antennas, and a dimensionality of the null space is $N_T$–L.

13. The apparatus of claim 12, wherein the controller is configured to select, over time, different orthogonal vectors as the one or more second steering vectors.

14. The apparatus of claim 12, wherein the controller is configured to select, over frequency, different orthogonal vectors as the one or more second steering vectors.

15. The apparatus of claim 11, further comprising one or more radio interfaces coupled to the controller, wherein the one or more radio interfaces are configured to couple to $N_T$ transmit antennas.

16. The apparatus of claim 11, wherein the controller is configured to generate the one or more independent vectors based on performing a singular value decomposition (SVD) of the partial channel matrix.

17. The apparatus of claim 11, wherein the controller is configured to:

determine an additional partial channel matrix corresponding to a reverse channel, and determine the partial channel matrix from the additional partial channel matrix.

18. The apparatus of claim 11, wherein the controller is configured to, when $N_S$ is less than or equal to L, select a set of one or more independent vectors as one or more third steering vectors to steer the one or more streams, wherein the number of independent vectors in set of one or more independent vectors is $N_S$.

19. A non-transitory computer readable storage medium tangibly storing machine readable instructions that, when executed by a processor, cause the processors to:

in a transmitter, for selecting steering vectors for transmitting one or more streams between the transmitter and a receiver, wherein the transmitter has a plurality of transmit antennas, the receiver has a plurality of receive antennas, the number of receive antennas in the plurality of receive antennas is $N_R$, and the number of streams in the one or more steams is $N_S$, the method comprising:

construct a partial channel matrix corresponding to an estimate of a multiple input, multiple output (MIMO) channel between (i) a plurality of transmit antennas at a transmitter and (ii) a set of one or more receive antennas of a plurality of receive antennas at a receiver, wherein the number of receive antennas in the plurality of receive antennas is $N_R$, and wherein the number of receive antennas in the set of one or more of the receive antennas is M, and M is less than $N_R$;

generate one or more independent vectors using the partial channel matrix, wherein the number of independent vectors in the one or more independent vectors is L, and L is a rank of the partial channel matrix; and when the number, $N_S$, of one or more streams to be transmitted from the transmitter to the receiver is greater than L, (i) select the one or more independent vectors as one or more first steering vectors to steer a first set of one or more streams in the one or more streams, wherein the number of streams in the first set of one or more streams is L, (ii) select one or more orthogonal vectors in a null space of the one or more independent vectors as one or more second steering vectors to steer a second set of one or more streams in the one or more streams, wherein the second set of one or more streams are not in the first set of one or more streams, (iii) utilize the one or more first steering vectors for transmitting the first set of one or more streams, and (iv) utilize the one or more second steering vectors for transmitting the second set of one or more streams.

20. The non-transitory computer readable storage medium of claim 19, tangibly storing machine readable instructions that, when executed by a processor, cause the processors to:

select, over time, different orthogonal vectors as the one or more second steering vectors.

21. The non-transitory computer readable storage medium of claim 19, tangibly storing machine readable instructions that, when executed by a processor, cause the processors to:

select, over frequency, different orthogonal vectors as the one or more second steering vectors.

22. The non-transitory computer readable storage medium of claim 19, tangibly storing machine readable instructions that, when executed by a processor, cause the processors to:

when $N_S$ is less than or equal to L, select a set of one or more independent vectors as a third set of one or more steering vectors to steer the one or more streams, wherein the number of independent vectors in the set of independent vectors is $N_S$.

* * * * *